US007420523B1

(12) United States Patent
Ziolkowski et al.

(10) Patent No.: US 7,420,523 B1
(45) Date of Patent: Sep. 2, 2008

(54) B-SANDWICH RADOME FABRICATION

(75) Inventors: Fred Ziolkowski, Medway, MA (US); Thomas Clark, Leominster, MA (US)

(73) Assignee: Radant Technologies, Inc., Stow, MA (US)

( * ) Notice: Subject to any disclaimer, the term of this patent is extended or adjusted under 35 U.S.C. 154(b) by 0 days.

(21) Appl. No.: 11/434,485

(22) Filed: May 15, 2006

Related U.S. Application Data

(63) Continuation of application No. 11/226,133, filed on Sep. 14, 2005, now abandoned.

(51) Int. Cl.
*H01Q 1/42* (2006.01)

(52) U.S. Cl. ..... 343/872

(58) Field of Classification Search ..... 343/872, 343/873

See application file for complete search history.

(56) References Cited

U.S. PATENT DOCUMENTS

| | | | | | |
|---|---|---|---|---|---|
| 3,115,271 | A | * | 12/1963 | Anderson et al. | 343/872 |
| 4,212,014 | A | | 7/1980 | Chekroun | |
| 4,297,708 | A | | 10/1981 | Vidal | |
| 4,320,404 | A | | 3/1982 | Chekroun | |
| 4,344,077 | A | | 8/1982 | Chekroun et al. | |
| 4,433,313 | A | | 2/1984 | Saint et al. | |
| 4,447,815 | A | | 5/1984 | Chekroun et al. | |
| 4,467,330 | A | | 8/1984 | Vidal et al. | |
| 4,518,966 | A | | 5/1985 | Sadones | |
| 4,531,126 | A | | 7/1985 | Sadones | |
| 4,552,151 | A | | 11/1985 | Bolomey et al. | |
| 4,656,487 | A | | 4/1987 | Sureau et al. | |
| 4,684,954 | A | | 8/1987 | Sureau et al. | |
| 4,864,321 | A | | 9/1989 | Sureau | |
| 5,001,495 | A | | 3/1991 | Chekroun | |
| 5,081,465 | A | | 1/1992 | Collignon | |
| 5,144,327 | A | | 9/1992 | Chekroun et al. | |
| 5,237,328 | A | | 8/1993 | Dorey et al. | |
| 5,408,244 | A | * | 4/1995 | Mackenzie | 343/872 |
| 5,574,471 | A | | 11/1996 | Sureau | |
| 5,579,015 | A | | 11/1996 | Collignon | |
| 5,579,024 | A | | 11/1996 | Sureau | |
| 5,598,172 | A | | 1/1997 | Chekroun | |
| 5,621,423 | A | | 4/1997 | Sureau | |
| 6,028,565 | A | * | 2/2000 | Mackenzie et al. | 343/872 |
| 6,107,976 | A | * | 8/2000 | Purinton | 343/872 |

OTHER PUBLICATIONS

R.H.J. Cary, *Radomes, in* The Handbook of Antenna Design, vol. 2, Chapter 14, (A.W. Rudge et al. eds., 1983). Peter Peregrinus Ltd. on behalf of the Institution of Electrical Engineers, London, UK (pp. 457-552).

Skolnik, M.I., Introduction to Radar Systems, Chapter 7, (1980, 2nd Edition) McGraw-Hill, Inc., New York, NY, pp. 264-269.

Publication entitled "Skolnik Radar Handbook," Ch.14, sections 14.1-14.3, pp. 14-2-14-21, date unknown.

* cited by examiner

*Primary Examiner*—Michael C Wimer
(74) *Attorney, Agent, or Firm*—Iandiorio Teska & Coleman

(57) ABSTRACT

A B-sandwich radome structure including a structural layer, an inside matching layer adjacent one side of the structural layer, and an outside matching layer adjacent an opposite side of the structural layer. Both matching layers are made of formable sheet material assembled with the structural layer during shaping of the radome and co-cured with the structural layer resulting in a rigid final form of the radome.

38 Claims, 3 Drawing Sheets

B-SANDWICH RADOME FABRICATION

RELATED APPLICATIONS

This application is a continuation of U.S. patent application Ser. No. 11/226,133, filed on Sep. 14, 2005, now abandoned entitled "B-SANDWICH RADOME FABRICATION", which is incorporated by reference herein.

FIELD OF THE INVENTION

This subject invention relates to radome structures.

BACKGROUND OF THE INVENTION

Radomes function to protect antennas such as radar and other antennas and associated equipment from environmental exposure and thus must exhibit suitable structural integrity, be capable of surviving structural, thermal and other stresses, and, in the case of aircraft radomes, be aerodynamic in design. Radomes must also be constructed to achieve certain desired electrical performance characteristics. Electrical considerations include minimum transmission loss, minimum beam deflection, minimum pattern distortion, and minimum reflected power. Typically, there is a trade off in the design of a radome as between structural, environmental, and electrical considerations.

There are many different types of materials used in constructing radomes and many different cross sectional configurations including single layer (typically made of a composite material), A-sandwich, B-sandwich, C-sandwich, and multiple-layer sandwich constructions.

The B-sandwich configuration wherein a high density composite core layer is sandwiched between two lower density skin layers is not commonly used. See Rudge, A. W., K. Miene, A. D. Oliver, and P. Knight, *The Handbook of Antenna Design*, Vol. 2, Chapter 14, Peter Peregrenus Ltd., London, UK, and Skolnik, M. I., *Introduction to Radar Systems*, Chapter 7, McGraw-Hill, New York, N.Y. incorporated herein by this reference. The most likely reason is that the fairly rigid material which would typically serve as the skin layers cannot be easily processed along with the central load bearing, core layer during the fabrication of the radome.

Still, a B-sandwich radome structure is advantageous in some instances because it provides transparency over a wide variety of frequencies and incident angles and also provides thermal insulation for the structural core layer.

SUMMARY OF THE INVENTION

It is therefore an object of this invention to provide a B-sandwich radome structure in which the matching skin layers can be assembled with the structural core layer in a process compatible with the manufacture of single material radome structure.

It is a further object of this invention to provide such a B-sandwich radome structure which exhibits transparency over a wide variety frequencies and incident angles.

It is a further object of this invention to provide such a B-sandwich radome structure which provides increased thermal insulation.

The subject invention results from the realization that a B-sandwich radome structure can be assembled in a process compatible with the manufacture of a single material radome structure if the inside and outside matching skin layers are made of formable sheets of uncured resin including air filled microspheres therein to lower the dielectric constant of the resin. Both matching layers are assembled with the formable prepreg structural layer plies during molding of the radome structure and co-cured therewith, eliminating the need to separately shape the matching layers and then secure them to an already formed and cured structural layer.

The subject invention, however, in other embodiments, need not achieve all these objectives and the claims hereof should not be limited to structures or methods capable of achieving these objectives.

This subject invention features a B-sandwich radome structure comprising a structural layer, an inside matching layer adjacent one side of the structural layer, and an outside matching layer adjacent an opposite side of the structural layer. Both matching layers are made of formable sheet material assembled with the structural layer during shaping of the radome and co-cured with the structural layer resulting in a rigid final form of the radome.

In a preferred embodiment, the matching sheet layer material during assembly includes an uncured thermoset resin with a plurality of gas-filled microspheres therein to reduce the dielectric constant of the matching layers. Typically, the microspheres are filled with air. The result is that the dielectric constant of each matching layer is between 1.3 and 3.0, preferably about 1.9.

The resin is typically an epoxy, cyanate ester, or bismaleimide. Each matching layer typically has a nominal thickness of between ¼ to ¾ of a wavelength for the frequency of interest. Each matching layer may have a density of between 20 to 60 lbs/ft$^3$, typically about 40 lbs/ft$^3$.

In one example, the structural layer includes plies of woven fabric impregnated with a resin. During assembly, the plies of the structural layer are typically in the form of a woven fabric, pre-impregnated with resin (prepreg). Typically there are between 10 and 30 plies at 10 GHz and the resin is an epoxy, cyanate ester, or bismaleimide.

The structural layer typically has a nominal thickness between ¼ to ¾ or ⅝ or more of a wavelength for the frequency of interest. There may also be a matching layer dividing two structural layers.

An uncured B-sandwich radome structure in accordance with this invention features a structural layer with a number of plies of fabric pre-impregnated with a resin, an inside matching layer adjacent one side of the prepreg structural layer, and an outside matching layer adjacent an opposite side of the structural layer. Both matching layers are made of formable sheets of uncured resin including a dielectric constant reducing agent therein. Preferably, the dielectric constant reducing agent includes a plurality of gas filled microspheres.

This invention also features a method of manufacturing a B-sandwich radome. The method comprises forming a layup of a radome shape including an inside matching layer, a structural layer, and an outside matching layer. The structural layer including plies of fabric pre-impregnated with a resin, and the matching layers each including uncured resin in sheet form with a dielectric constant reducing agent therein. A preferred method further includes the step of co-curing all the layers in an autoclave or oven. Preferably, a breather sheet is placed adjacent one matching layer between it and the mold or mandrel to assist in outgassing.

Typically, the dielectric constant reducing agent includes a plurality of gas (e.g., air) filled microspheres.

A radome structure in accordance with this invention includes at least one structural layer, and a matching layer made of a formable sheet material assembled with the structural layer during shaping of the radome structure and co-cured with the structural layer resulting in a rigid final form of the radome. There may be a single structural layer, an inside matching layer adjacent one side of the structural layer, and an outside matching layer adjacent an opposite side of the structural layer. In another embodiment, there are two structural layers and a matching layer between the two structural layers. This structure optionally includes an inside matching layer adjacent one side of one structural layer and an outside matching layer adjacent one side of the other structural layer.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
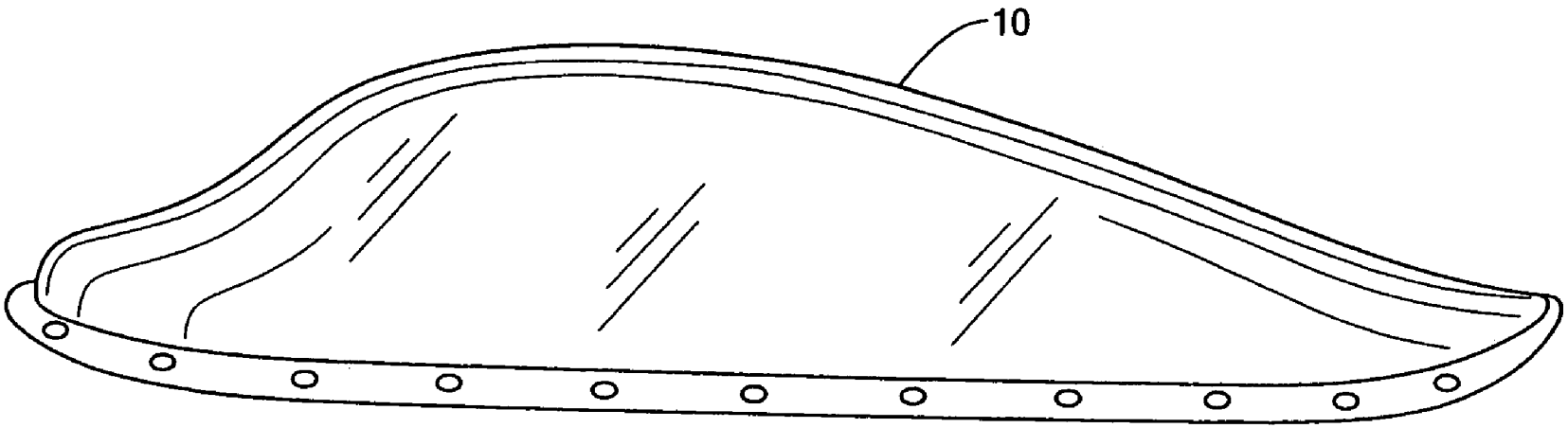
FIG. 1 is a schematic three-dimensional view showing an example of a B-sandwich radome in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
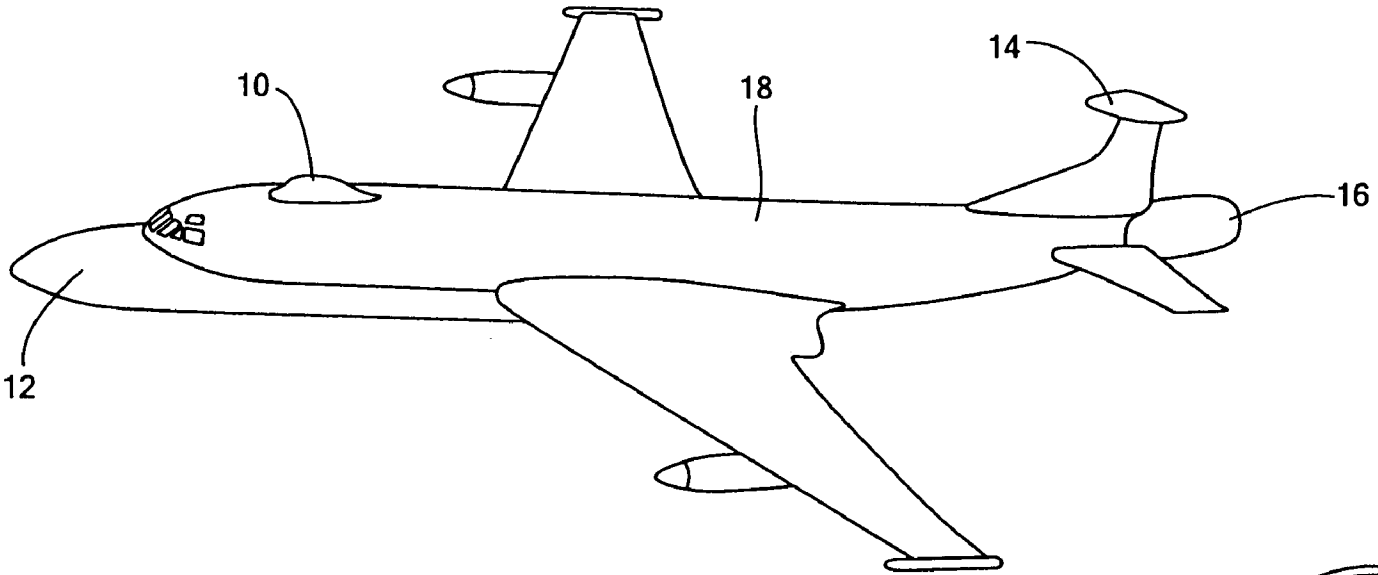
FIG. 2 is a schematic view showing an aircraft with a number of radomes affixed thereto which can be B-sandwich in construction in accordance with the subject invention.
Figure 3:
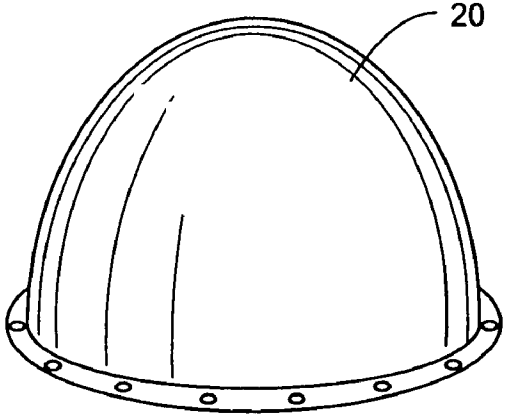
FIG. 3 is a schematic three-dimensional view showing another type of B-sandwich radome in accordance with the subject invention as might typically be found on a ship, a ground vehicle, or as a stationary ground installation.

FIG. 1 shows an example of a B-sandwich radome 10 in accordance with the subject invention for an aircraft. FIG. 2 shows radome 10 and other radomes 12, 14, and 16 on aircraft 18. Many radome shapes are possible in accordance with the subject invention and FIG. 3 shows a more typical ground, ship or vehicle mounted radome 20 also in accordance with the subject invention. As explained in the background section above, radomes protect antennas and other equipment from environmental exposure and at the same time must also exhibit desirable electrical transparency.

Figure 4:
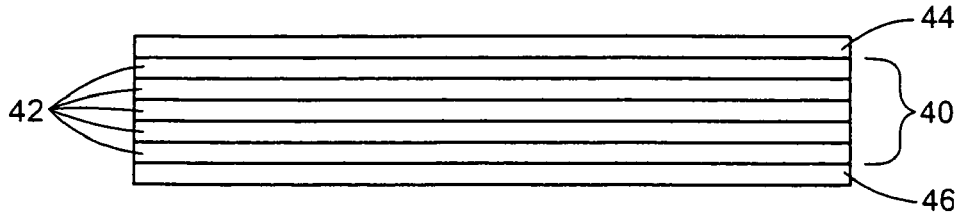
FIG. 4 PRIOR ART
FIG. 4 is a highly schematic cross-sectional view of a prior art single material radome wall.

FIG. 4 shows a typical prior art construction for a radome comprising a structural layer 40 and paint layers 44 and 46. When composite materials are used, structural layer 40 is typically made of a number of plies 42, typically 20 plies each 10 mils thick at 10 GHz. The number of plies will depend on the frequency of interest. Plies 42 each typically include a woven fabric pre-impregnated with a resin (prepreg). In this way, the fairly complex radome shapes of FIGS. 1-3 can be fabricated. The plies, are laid up in a mold or on a mandrel for shaping and then cured typically in an autoclave or oven.

As also explained in the background section above, a B-sandwich radome structure is desirable in some instances but not commonly used because matching layers or skins would have to be formed separately from structural layer 40 and then somehow attached to it.

Figure 5:
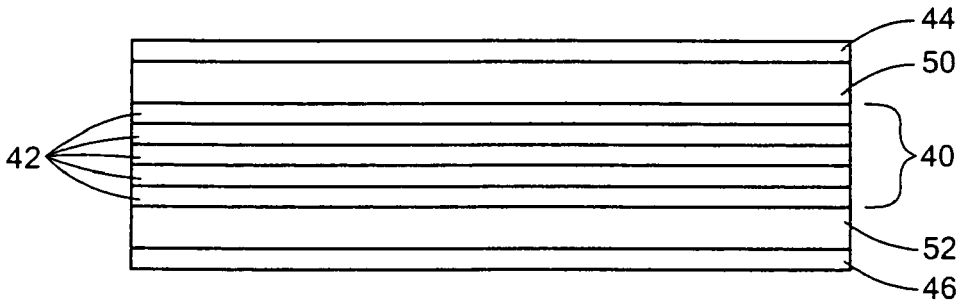
FIG. 5 is a highly schematic cross-sectional view of a portion of a B-sandwich radome structure in accordance with the subject invention.

In accordance with the subject invention, however, the B-sandwich radome structure shown in FIG. 5 includes structural layer 40 typically including a number of plies 42 as in the case of a single material radome structure but also including inside (e.g., interior) matching skin layer 50 and outside (e.g., exterior) matching skin layer 52. Paint layers 44 and 46 may also be included.

Both matching layers 50 and 52 are preferably made of a formable sheet material assembled on opposite sides of structural layer 40 during shaping of the radome into its specific shape as shown in the examples of FIGS. 1-3 (or other shapes) and co-cured with structural layer 40 resulting in a final rigid B-sandwich radome structure made according to a process compatible with the process used to manufacture a prior single material radome structure as shown in FIG. 4.

During assembly in the preferred embodiment, matching sheet layers 50 and 52 are made of an uncured thermoset resin with a dielectric constant reducing agent therein. Typical resins include various epoxies, cyanate ester, and, for high temperature applications, BMI (bismaleimide). But, these resins typically exhibit a dielectric constant of 2.5-3.5. Thus, a dielectric constant reducing agent such as a number of air-filled microspheres are added to the resin to produce matching skin layers with a dielectric constant of between 1.3 to 3.0, more typically approximately 1.9. In one example, 100 micron diameter air filled silicate glass microspheres were added to the resin until the density of the resulting matching layers was between 20 to 60 lbs/ft$^3$, typically about 40 lbs/ft$^3$. With the microspheres, the dielectric constant of the resin was about 1.9 and the resin could still be worked into an uncured sheet form of a predetermined constant thickness. Typically, each matching layer 50 and 52 has a nominal thickness of ¼ to ¾ wavelength for the frequencies of interest. No reinforcing fibers are usually included in matching layers 50 and 52.

The plies 42 of prepreg structural layer 40 are typically made of woven fabric but unidirectional fibers, randomly oriented fibers, and other composite technologies used to manufacture radomes may be used. E-glass fibers, S-type, D-type, or quartz fibers can be used. Usually, the same resin used for matching layers 50 and 52 is used in the plies 42 of the prepreg sheets forming structural layer 40. During layup, plies are added until the desired thickness of structural layer 40 is reached, for example, ¼ to ¾ of a wavelength or even ⅝ a wavelength or more for the frequencies of interest.

These formable resin sheets are then patterned and cut as necessary and laid up with structural layer 40 as is known in the composite arts in a mold or on a mandrel. A perforated, high temperature breather sheet (typically made of Teflon) is disposed between the mold or mandrel and the lay-up to prevent pock marks or cavities in the matching layer adjacent the mold or mandrel caused by outgassing of volatiles during the cure cycle. The breather sheet allows outgassing of the volatiles in the matching layer closest to the mold or mandrel. This lay-up is then cured in an autoclave or oven as is conventional during the manufacture of a single material radome structure. The air-filled glass microspheres advantageously survive the pressures involved in forming and curing matching layers 50 and 52 resulting in matching layers with the desired dielectric constant. Also, during curing, matching layers 50 and 52 are thoroughly adhered to structural layer 40.

Figure 6:
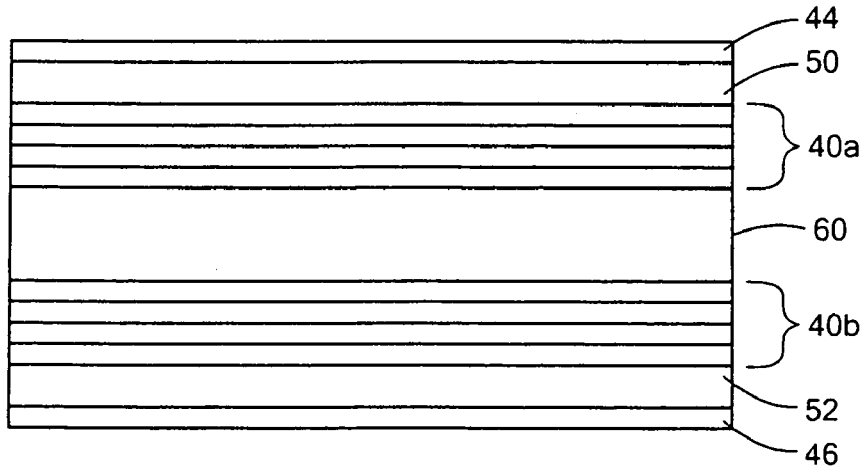
FIG. 6 is a highly schematic cross-sectional view of more complex derivative of a B-sandwich radome structure in accordance with the subject invention which includes an intermediate matching layer.

In another embodiment as shown in FIG. 6 for a more complex derivative of a traditional B-sandwich structure, there is an intermediate "matching" layer 60 dividing two structural layers 40*a* and 40*b*. Matching layer 60 is formed in a manner discussed above with respect to the matching layers 50 and 52 shown in FIG. 5. In the structure of FIG. 6, matching layers 50 and 52 are optional.

In any embodiment, the result is a radome structure in which the resin based matching layers can be assembled with the structural layer in a process compatible with the manufacture of single material radome structure. The radome structures of the subject invention provide increased thermal insulation and exhibit transparency over a wider variety of frequencies and incident angles.

Since inside and outside matching skin layers 50 and 52, FIG. 5 (and/or layer 60, FIG. 6) are made of formable sheets of uncured resin typically including air filled microspheres therein to lower the dielectric constant of the resin, the various radome structures of this invention can be assembled in a process compatible with the manufacture of a single material radome structure. Typically, both matching layers are assembled with the formable prepreg plies of structural layer 40 during shaping of the radome structure and then co-cured therewith.

The subject invention, however, in other embodiments, need not achieve all these objectives and the claims hereof should not be limited to structures or methods capable of achieving these objectives.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A B-sandwich radome structure comprising:

a structural layer including plies of fibers in a resin matrix;

an inside matching layer adjacent to one side of the structural layer; and an outside matching layer adjacent to the opposite side of the structural layer, both matching layers having a dielectric constant lower than a dielectric constant of the structural layer and made of formable sheet material assembled with the structural layer during shaping of the radome and co-cured with the structural layer resulting in a rigid final form of the radome, the matching sheet layer material during assembly including an uncured thermoset resin with a plurality of gas-filled microspheres therein to reduce the dielectric constant of the matching layers.

2. The B-sandwich radome structure of claim 1 in which the microspheres are filled with air.

3. The B-sandwich radome structure of claim 1 in which the dielectric constant of each matching layer is between 1.3 and 3.0.

4. The B-sandwich radome structure of claim 3 in which the dielectric constant of each matching layer is approximately 1.9.

5. The B-sandwich radome structure of claim 1 in which the resin is an epoxy, cyanate ester, or bismaleimide.

6. The B-sandwich radome structure of claim 1 in which each matching layer has a nominal thickness of between ¼ to ¾ wavelength for the frequency of interest.

7. The B-sandwich radome structure of claim 1 in which each matching layer has a density of between 20 to 60 lbs/ft$^3$.

8. The B-sandwich radome structure of claim 7 in which each matching layer has a density of approximately 40 lbs/ft$^3$.

9. The B-sandwich radome structure of claim 1 in which the structural layer includes plies of fabric impregnated with a resin.

10. The B-sandwich radome structure of claim 9 in which during assembly, the structural layer is a prepreg.

11. The B-sandwich radome structure of claim 9 in which the fabric is a woven fabric.

12. The B-sandwich radome structure of claim 9 in which there are between 10 and 30 plies at 10 GHz.

13. The B-sandwich radome structure of claim 9 in which the resin is an epoxy, cyanate ester, or bismaleimide.

14. The B-sandwich radome structure of claim 1 in which the structural layer has a minimal thickness of between ¼ to ¾ or ⅝ or more wavelength for the frequency of interest.

15. The radome structure of claim 1 further including a matching layer dividing two structural layers.

16. An uncured B-sandwich radome structure comprising:

a prepreg structural layer with a number of plies of fabric impregnated with a resin;

an inside matching layer adjacent to one side of the prepreg structural layer; and an outside matching layer adjacent to the opposite side of the structural layer, both matching layers having a dielectric constant lower than a dielectric constant of the structural layer and made of formable sheets of uncured resin including a dielectric constant reducing agent therein, the dielectric constant reducing agent including a plurality of gas filled microspheres.

17. The uncured B-sandwich radome structure of claim 16 in which the microspheres are filled with air.

18. The uncured B-sandwich radome structure of claim 16 in which the dielectric constant of each matching layer is between 1.3 and 3.0.

19. The uncured B-sandwich radome structure of claim 16 in which the resin of the prepreg structural layer and both matching layers is an epoxy, cyanate ester, or bismaleimide.

20. The uncured B-sandwich radome structure of claim 18 in which each matching layer has a nominal thickness of between ¼ to ¾ of a wavelength for the frequencies of interest.

21. The uncured B-sandwich radome structure of claim 16 in which each matching layer has a density of between 20 to 60 lbs/ft$^3$.

22. The uncured B-sandwich radome structure of claim 21 in which each matching layer has a density of approximately 40 lbs/ft$^3$.

23. The uncured B-sandwich radome structure of claim 16 in which the fabric is a woven fabric.

24. The uncured B-sandwich radome structure of claim 16 in which there are between 10 and 30 plies typically at 10 GHz.

25. The uncured B-sandwich radome structure of claim 16 in which the structural layer has a nominal thickness of between ¼ to ¾ or ⅝ or more wavelength for the frequency of interest.

26. The uncured B-sandwich radome structure of claim 16 further including a matching layer dividing two structural layers.

27. A method of manufacturing a B-sandwich radome, the method comprising:

forming a layup of a radome shape including an inside matching layer, a structural layer, and an outside matching layer;

the structural layer including plies of fabric pre-impregnated with a resin; and the matching layers each having a dielectric constant lower than a dielectric constant of the structural layer and including uncured resin with a dielectric constant reducing agent therein, the dielectric constant reducing agent including a plurality of gas filled microspheres.

28. The method of claim 27 in further including the step of co-curing all the layers.

29. The method of claim 28 in which co-curing occurs in an autoclave or oven.

30. The method of claim 29 further including the step of placing a breather sheet adjacent one matching layer to assist in outgassing.

31. The method of claim 27 in which the microspheres are filled with air.

32. A radome structure comprising:

at least one structural layer including plies of fibers in a resin matrix; and a matching layer having a dielectric constant lower than a dielectric constant of the structural layer and made of a formable sheet material assembled with the structural layer during shaping of the radome structure and co-cured with the structural layer resulting in a rigid final form of the radome, the matching layer including a dielectric constant reducing agent therein, the dielectric constant reducing agent including a plurality of gas filled microspheres.

33. The radome structure of claim 32 in which there is a single structural layer, an inside matching layer adjacent one side of the structural layer, and an outside matching layer adjacent an opposite side of the structural layer.

34. The radome structure of claim 32 in which there are two structural layers and a matching layer between the two structural layers.

35. The radome structure of claim 34 further including an inside matching layer adjacent one side of one structural layer and an outside matching layer adjacent one side of the other structural layer.

36. A B-sandwich radome structure comprising:

a structural layer;

an inside matching layer adjacent to one side of the structural layer; and an outside matching layer adjacent to the opposite side of the structural layer, both matching layers made of formable sheet material assembled with the structural layer during shaping of the radome and co-cured with the structural layer resulting in a rigid final form of the radome, the matching sheet layer material during assembly including an uncured thermoset resin with a plurality of gas-filled microspheres therein to reduce the dielectric constant of the matching layers.

37. An uncured B-sandwich radome structure comprising:

a prepreg structural layer with a number of plies of fabric impregnated with a resin;

an inside matching layer adjacent to one side of the prepreg structural layer; and an outside matching layer adjacent to the opposite side of the structural layer, both matching layers made of formable sheets of uncured resin including a dielectric constant reducing agent therein, the dielectric constant reducing agent including a plurality of gas filled microspheres.

38. A method of manufacturing a B-sandwich radome, the method comprising:

forming a layup of a radome shape including an inside matching layer, a structural layer, and an outside matching layer;

the structural layer including plies of fabric pre-impregnated with a resin; and the matching layers each including uncured resin with a dielectric constant reducing agent therein, the dielectric constant reducing agent including a plurality of gas filled microspheres.

* * * * *